US007146240B2

(12) United States Patent
Shad

(10) Patent No.: US 7,146,240 B2
(45) Date of Patent: Dec. 5, 2006

(54) SEWING MACHINE HAVING A WIRELESS SWITCH AND INDEPENDENT CONTROLLER

(76) Inventor: Philip Shad, 53 Oakfield Close, Potters Bar, Hertsfordshire, EN6 2BE (GB)

( * ) Notice: Subject to any disclaimer, the term of this patent is extended or adjusted under 35 U.S.C. 154(b) by 0 days.

(21) Appl. No.: 10/507,541

(22) PCT Filed: May 1, 2003

(86) PCT No.: PCT/GB03/01842

§ 371 (c)(1),
(2), (4) Date: Sep. 9, 2004

(87) PCT Pub. No.: WO03/106750

PCT Pub. Date: Dec. 24, 2003

(65) Prior Publication Data

US 2005/0115481 A1 Jun. 2, 2005

(30) Foreign Application Priority Data

Jun. 12, 2002 (GB) ..... 0213418.7

(51) Int. Cl.
*D05B 19/02* (2006.01)

(52) U.S. Cl. ..... 700/136; 112/277

(58) Field of Classification Search ..... 700/136, 700/137, 138; 112/470.01, 220, 275, 277
See application file for complete search history.

(56) References Cited

U.S. PATENT DOCUMENTS 4,075,961 A * 2/1978 Harris ..... 112/277
5,247,449 A * 9/1993 Yoshida ..... 700/136

* cited by examiner

*Primary Examiner*—Danny Worrell

(57) ABSTRACT

A sewing machine is constructed to receive the transmission of one or more of wireless switches, said one or more switches being used to transmit simultaneously. Sewing machines are transmitted to in various start and stop sewing operations by one individual operator and or a group of individual operators using their allocated sewing machines. A rechargeable battery is used. The speed controller is attached to the machine body. The receiver box supplies the voltage to recharge the battery for the transmitter.

3 Claims, 8 Drawing Sheets

SEWING MACHINE HAVING A WIRELESS SWITCH AND INDEPENDENT CONTROLLER

BACK GROUND OF THE INVENTION

1. Field of Invention

The present invention relates to a sewing machine and more particularly to a sewing machine having a wireless switch and a independent operating speed controller attached to the machine body of the sewing machine.

There are safety instances when a sewing machine needs to be operated by remote control where for example the remote control eliminates the cable between a transmission switch and the machine body. A sewing machine with the above mentioned switch can also be used where a person has restricted movement. The transmitter switch may be hand held, placed on the floor, attached to the arm, or wrist, enabling the operator too guide the material when transmitting. The wireless switch is portable.

The independent controller which is attached to the machine body can limit the operating speed of the machine. This may be done manually. This can also prevent industrial operators sewing to fast and reducing the quality of the seams. It can also be used whenever serveral sewing machines work simultaneously, and one single operator can use the remote wireless on/off switch by first selecting the operating motor speed on the machine body and then activating the wireless switch to start the sewing machine.

2. Description of Related Art

U.S. Pat. No. 4,976,552. Describes a remote control sewing machine, where the connection between the transmitter and the receiver is ensured by an optical signal. In the technical solution described, the analogue signal picked up from a variable resistor, which corresponds to the sewing machine foot controller is applied to an analogue digital converter, and the numerical signal obtained is modulated by a conveyor which connects to an optical tansmitter. The receiver obtains, after demodulation, a signal with variable amplitude, which controls the sewing machine motor, in this way, by activating the variable resistor of the remote control the motor roation speed is activated as well. The solution described above is complicated as it needs a numerical analogue converter in the command unit, and because it uses light to transmit information, and poses difficulties for the simultaneous operation of several machines, and therefore this solution has a limited application.

Japanese reference JP 59 050 792 tries to overcome this shortcoming and uses radio frequency, in this case, the command signal obtained on a variable resistor (which corresponds to the sewing machine foot controller) modulates in impulses a radio frequency conveyor with a rectangular signal whose frequency is dependent on the position of the foot controller; after demodulation, the receiver obtains a rectangular signal which, after having been amplified, is applied to a tiltable non-stable circuit. The rectangular signal which has a variable frequency, is applied to a lower filter, which converts the variable signal of the frequency into a variable tension signal. This signal controls an optic connector, and once processed, the obtained signal controls the rotation of the motor. The solution described above allows the operation of several sewing machines by a single remote control but it is sensitive to interference radiation which is generated by the sewing machine motors.

U.S. Pat. No. 5,247,449 tries to overcome this shortcoming and uses radio frequency. In this case, the command signal is picked up from a variable resistor (which corresponds to the sewing machine foot controller). An analogue digital converter is applied, and then after the frequency modulation (FM) of a radio-frequency signal, the signal is emitted; at reception, after demodulation, in a control block, the signal undergoes a reverse digital analogue conversion and the variable signal controls the motor rotation, A replacement battery is used, the machine will stop operating when the battery has reached a certain level of power to indicate to the operator that the battery needs to be replaced otherwise the machine will malfunction by running continually and cannot be stopped and the speed cannot be changed because the signal cannot be transmitted. As it uses a radio frequency signal as a conveyor, this technical solution allows the operation of several sewing machines by a single remote control, but it remains complicated: It needs coding and decoding of the information to the signal modulation and demodulation, moreover, even if the frequency modulation (FM) is used to transmit the command signal, it is possible that various radio frequency signals—and here we have the interference signals generated by the sewing machine motor—will overlap and disturb the useful signal; The use of frequency modulation requires the use of a relatively wide band, and therefore there is more interference with the received signal, even with the use of (additional coding/decoding operations, it is possible to disturb the received signal, and implicitly the functioning of the sewing machine. With regard to the replacement battery it is imperative for the operator to see the message on the machine to prepare for battery replacement otherwise the safety of the operator may be at risk due to malfunction of the sewing machine and loss of garment production

SUMMARY OF THE INVENTION

It is an object of the present invention to provide a sewing machine having a wireless switch and a independent controller attached to the machine body providing a sewing machine substantially free from interference from a radio wave signal from other transmitters and to prevent the machine malfuction by running continually where the machine cannot be stopped and the machine speed cannot be changed. It is another object of the present invention to provide a rechargable battery in a wireless switch so that continuous data to run the sewing machine and then the machine will stop if the data fails and when the rechargable battery runs out of power the machine will not start and for anything that breaks the transmission the machine will automatically stop.

Figure 5:
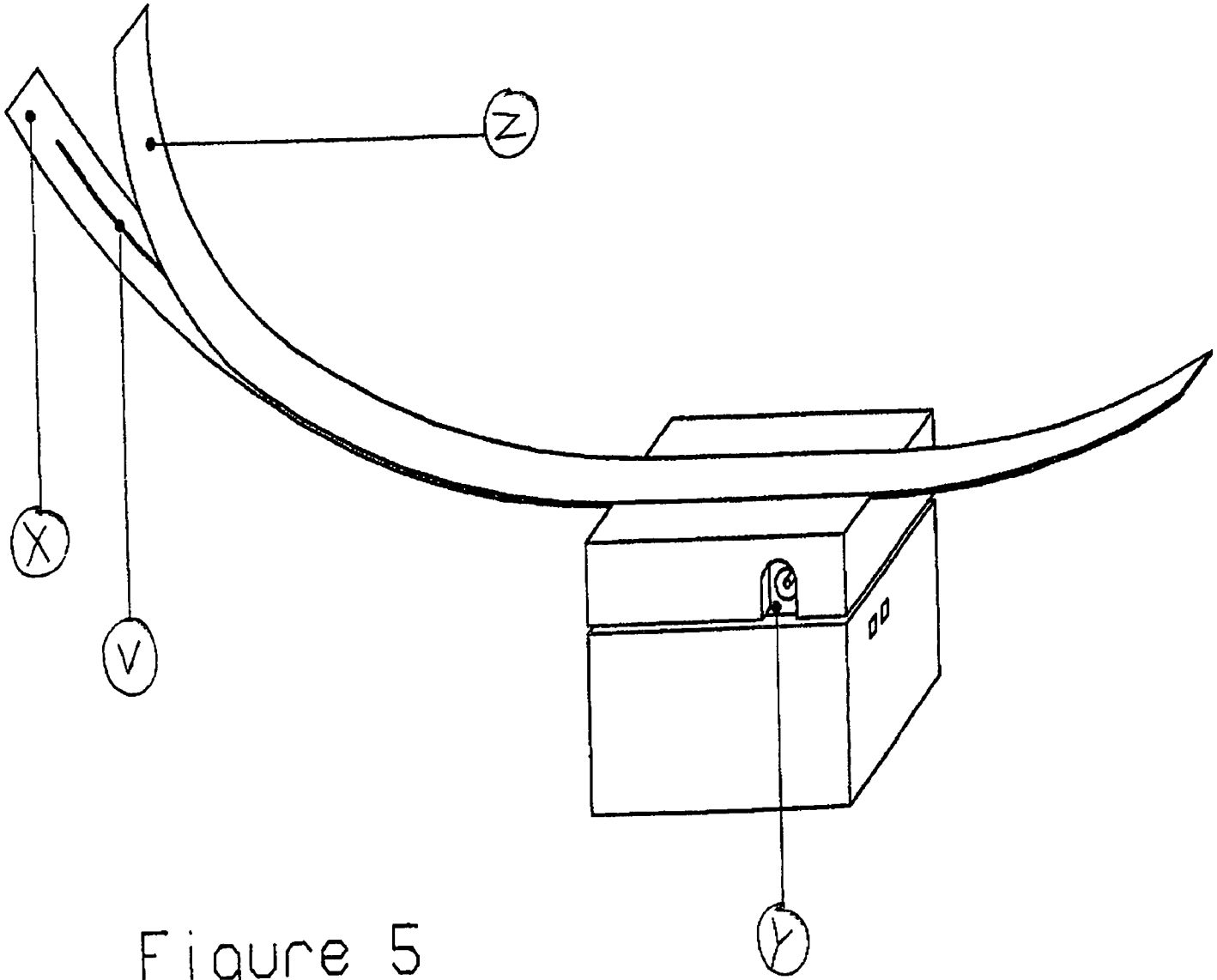
FIG. 5 Is a diagram illustrating the following (Z) a strap attached to transmitter box. (X) a strap attached to transmitter box providing insulation for wire. (V) wire along the full length of the strap. (Y) DC power rechargable power socket.
Figure 6:
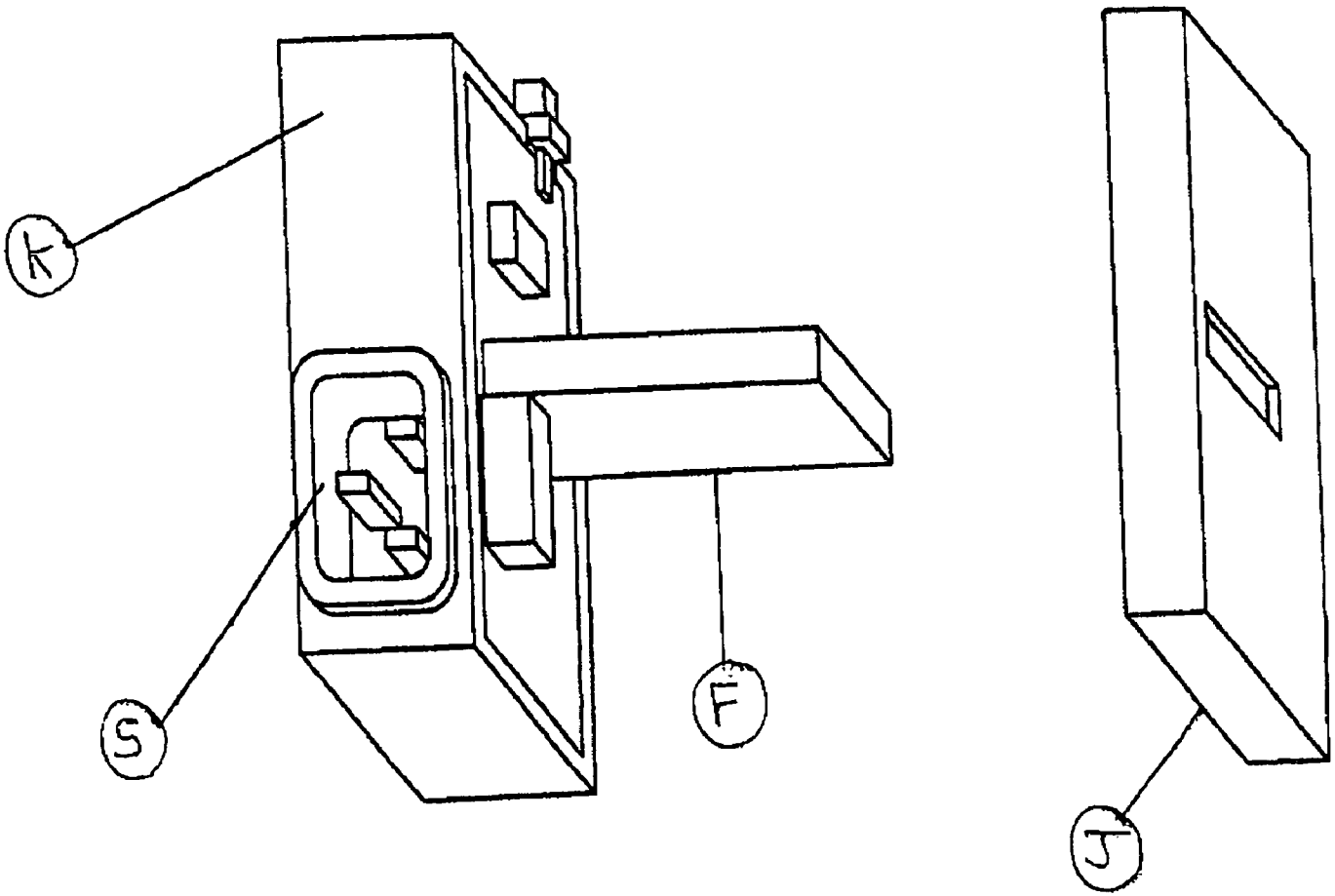
FIG. 6 Is a diagram illustrating the following, the opposite side view of FIG. (1). (S) IEC inlet mains connection. (K) receiver box. (F) connector to sewing machine. (J) lid of receiver box.

There is a strap FIG. 5 (Z) attached to the transmitter box that contains a insulated wire (V) to reactivate a small amount of signal and transmits from a restricted location or area when the circuit is mostly obscured by the body and clothing this ensures that each individual sewing machine of one or more being operated in a confined working area of a minimum distance of 30 cms apart and 30 cms in front of the sewing machine from the first sewing machine to the next machine for operational use and there after to the same distance and frontage apart for the use in a school classroom, sewing design sample room, garment factory, in the home, and any suitable working environment, being transmitted by one wireless switch or more than one transmitted switches being activated for one sewing machine or more than one machine simultaneously used, and sewing machines being ramderley transmitted in various start and stop sewing operations by one individual operator and or a group of individual operators using allocated sewing machines for their sewing requirements, for example stitching the seams of curtains.

Figure 7:
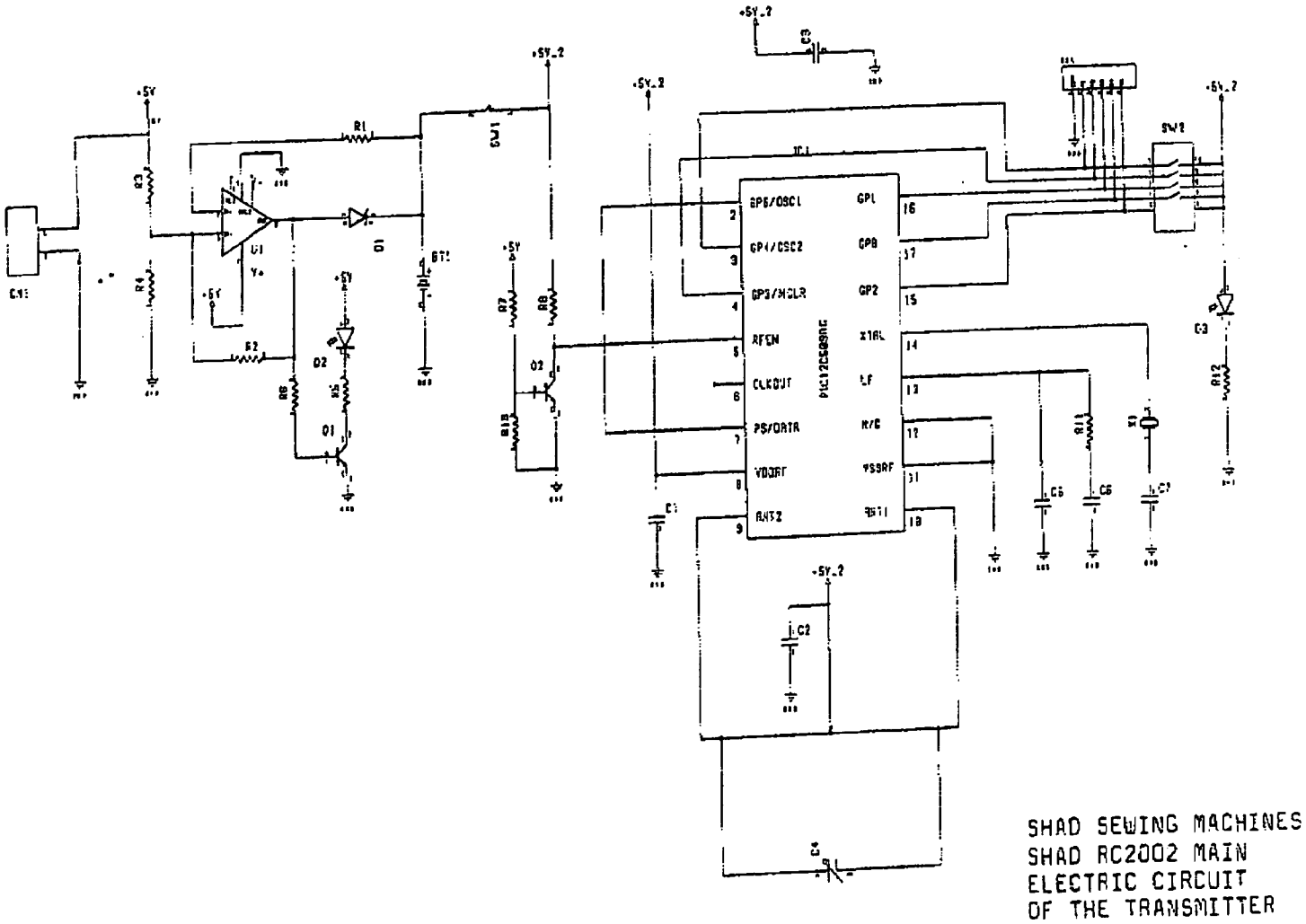
FIG. 7 Is a schematic electric circuit of the transmitter.
Figure 8:
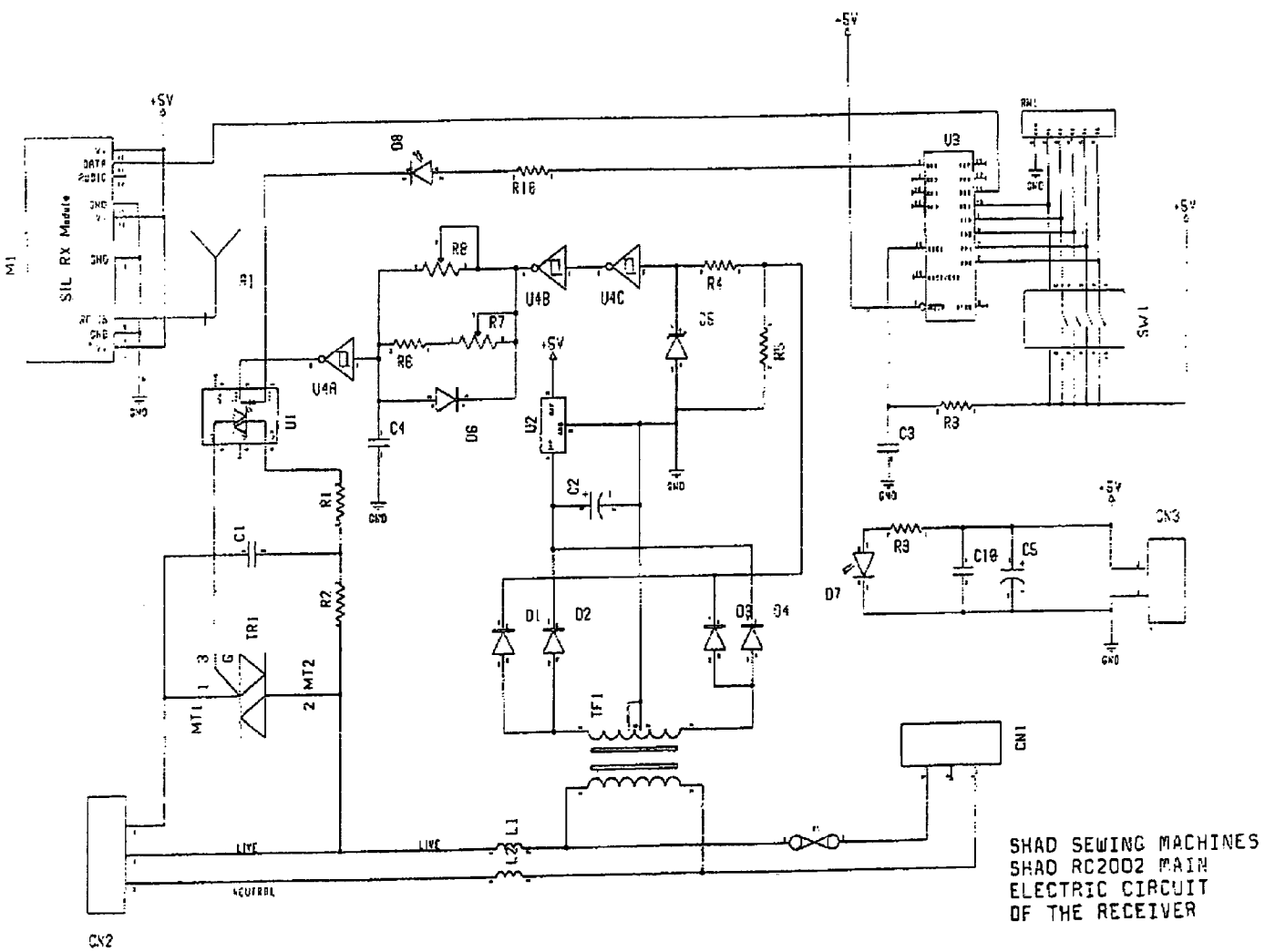
FIG. 8 Is a schematic electric circuit of the receiver.

There is for a sewing machine having the use of the micoprocesser. FIG. 7 and FIG. 8, that enables to use a digital coded transmission given a large number of wireless switches the frequency reference of the transmitter is a single crystal or a saw device and does not require multiple frequencies micrprocessor in the transmitter that enables the output of a psuedo-random signal to avoid interference from adjusted units using amplitude modulation. A sewing machine while receiving transmission from the wireless switch has a second wireless switch that can be charged on the receiver box attached to the sewing machine. The second wireless switch is disabled when there is a 5 volt supply present to recharge the battery. The receiver box supplies 5 volts for the transmitter to recharge. This also avoids a independent power battery charger. This provides continous battery charging while the machine which is in use providing 24 hours of operating use of the machine most useful in a garment factory for continous production.

Figure 1:
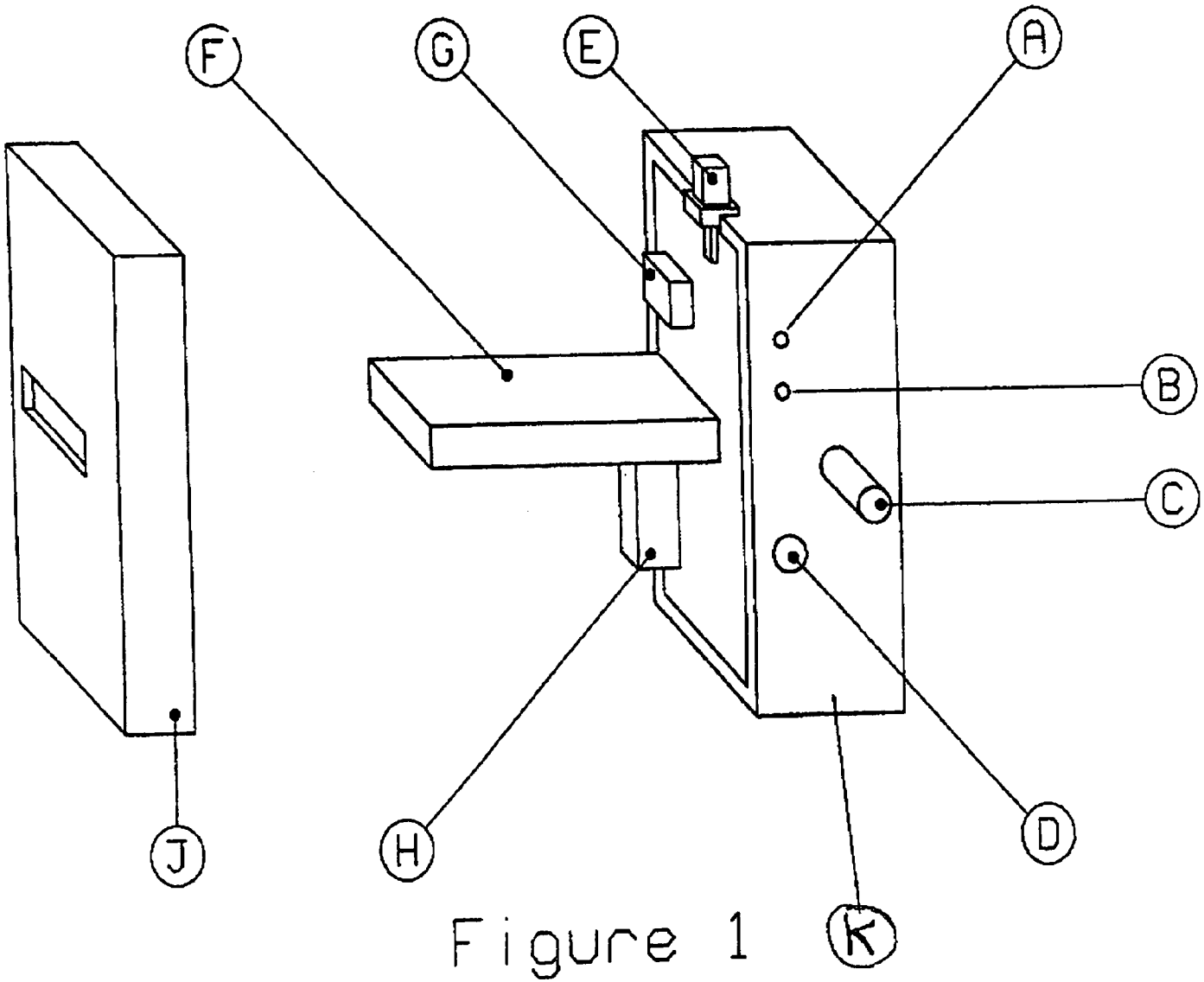
FIG. 1 Is a diagram illustrating the following (A) operate LED. (B) power LED. (C) speed control. (D) calibration for the motor. (E) recharging point. (F) connector to the sewing machine. (G) dil switches for coding. (H) fuse. (J) lid of receiver box. (K) receiver box.
Figure 2:
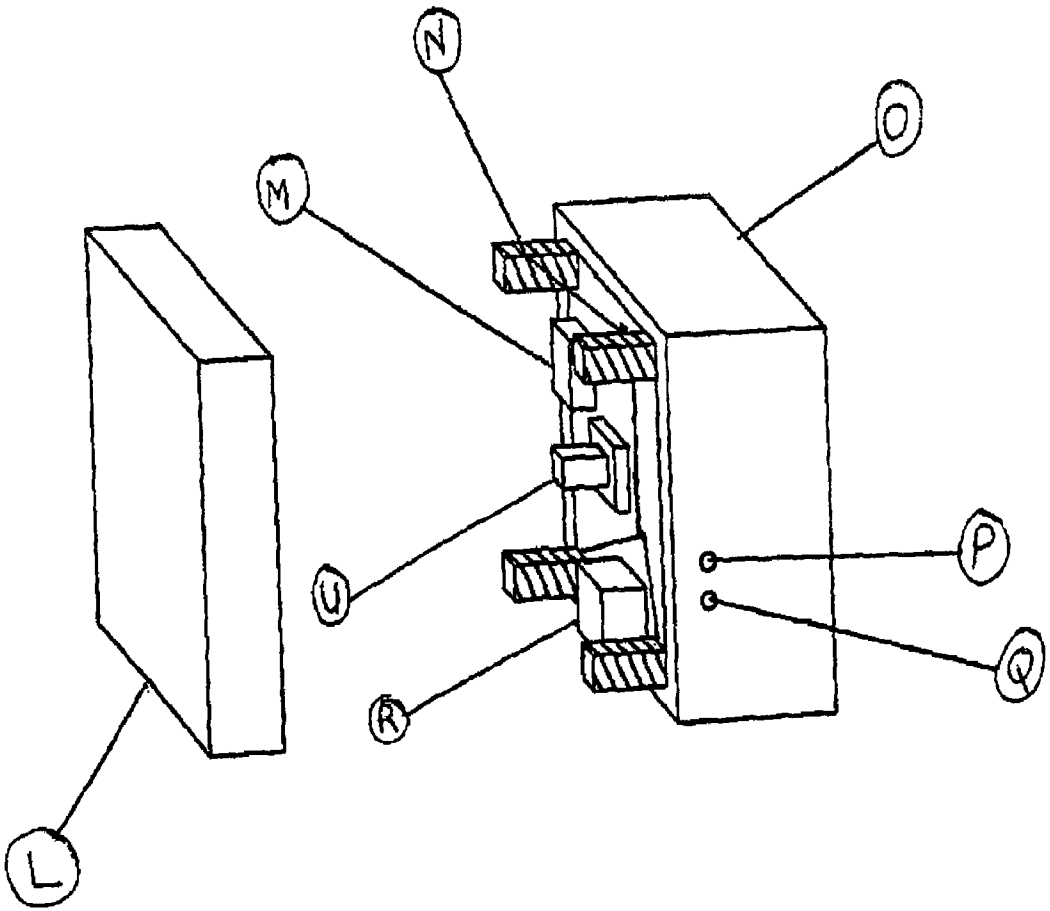
FIG. 2 Is a diagram illustrating the following (P) battery charger LED. (Q) operate LED. (U) operating switch and spring. (R) recharge connector. (M) dil switches for coding. (N) four springs. (O) transmitter box. (L) lid of transmitter box.
Figure 3:
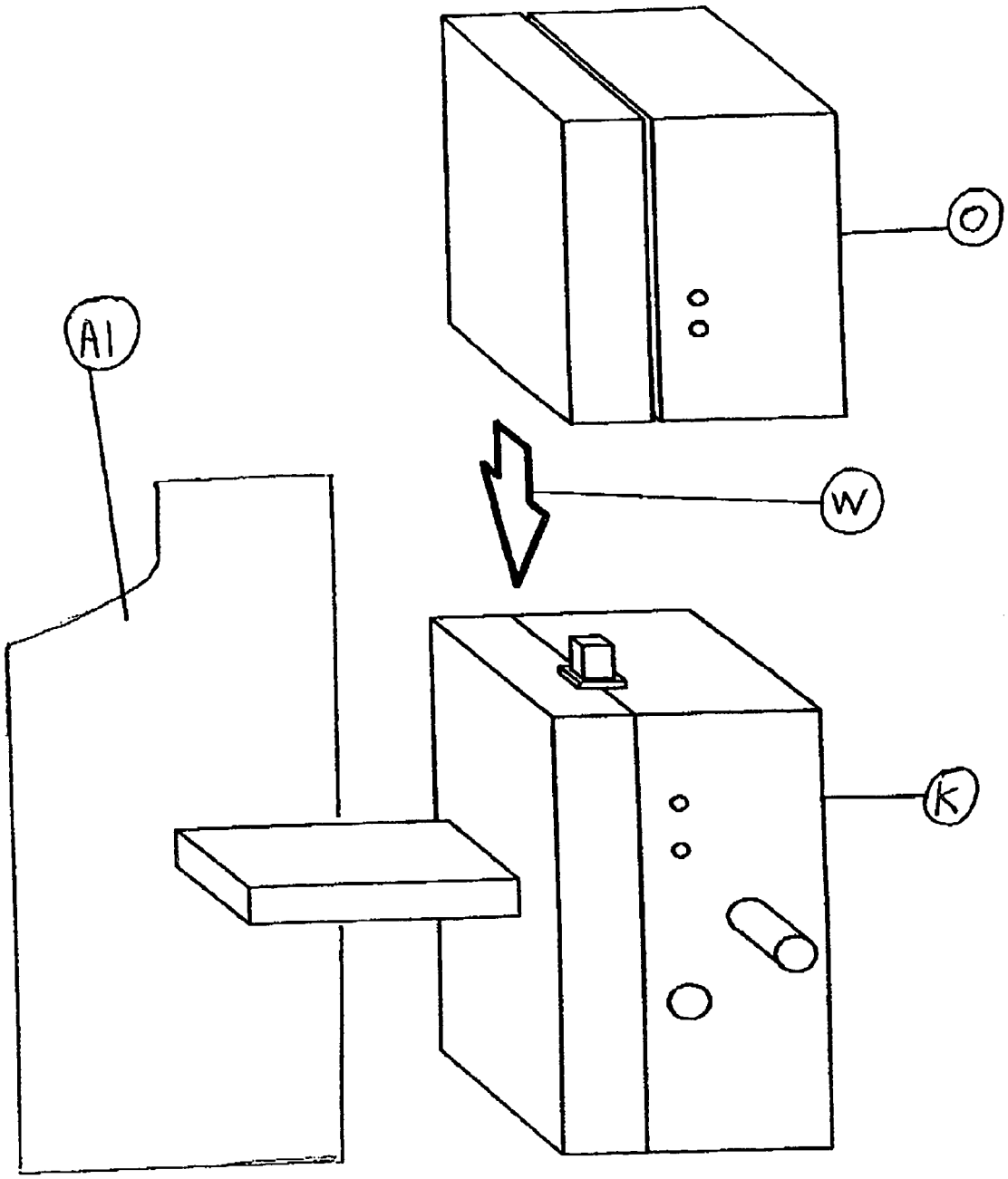
FIG. 3 Is a diagram illustrating the following<(O) transmitter box. (K) receiver box. (W) view to recharge transmitter box. (A1) sewing machine block.
Figure 4:
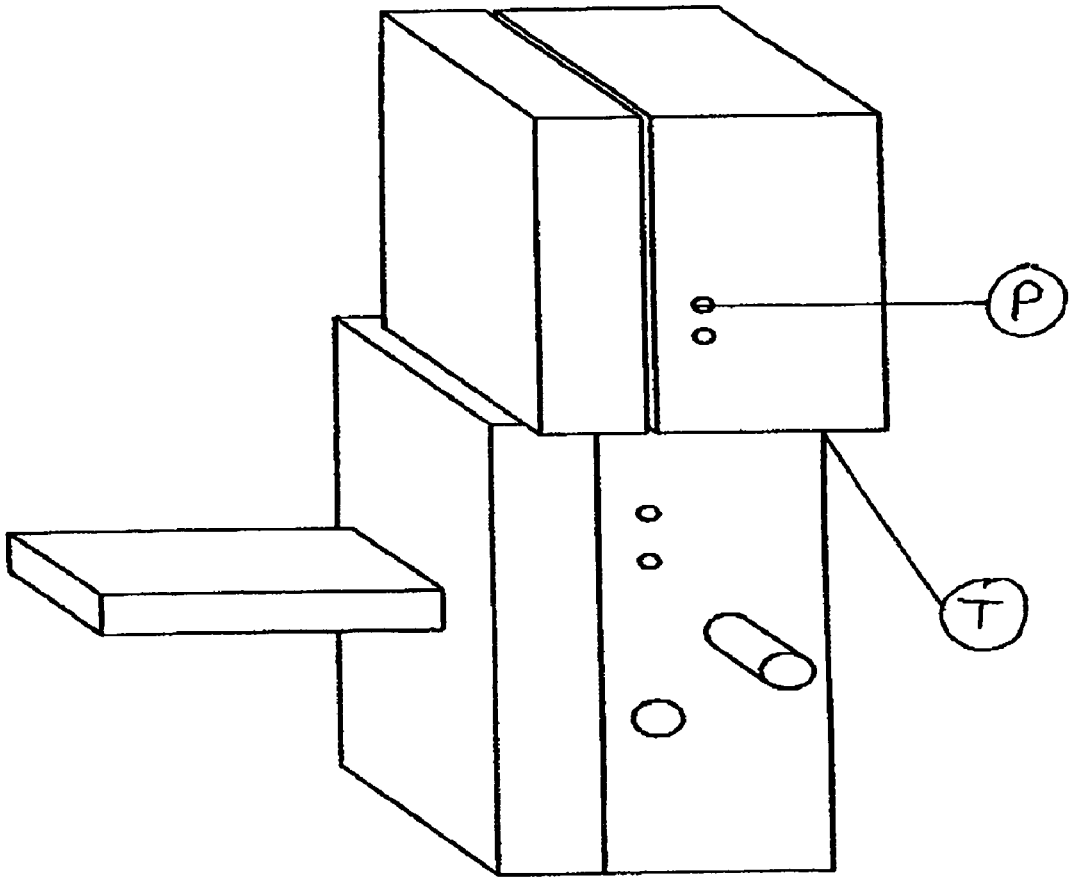
FIG. 4 Is a diagram illustrating the following (P) battery charger LED. (T) the battery recharging position of the transmitter box and receiver box.

The receiver box FIG. 1(B) powerLED. The transmitter box FIG. (2). (P) battery charger LED.

Using one transmitter switch the receiver for recharging is unplugged from sewing machine and plugged with the IEC mains supply lead into the mains socket.

DESCRIPTION OF THE PREFERRED EMBODIMENTS

Now, Embodiments of a sewing machine of the present invention will be described in detail herein below with reference to the accompanying drawings.

FIG. 7 is a Schematic electric circuit of the RC2002 transmitter. A 3.6 volt recharable battery, bt1, powers the transmitter; this can be recharged from the 5 volt input on cn1. The receiver plugs into cn1 and provides 5 volts dc for this purpose.

R3 and r4 produce a reference voltage; this is compared with the battery voltage, via r1, by the op-amp u1. IF the battery voltage is less than 4 v then the output of u1 becomes positive and charges the battery. The charging current is limited to about 8 mA by the output restrictions inherent in the op-amp and D1 prevents back leakage from the battery when the supply is disconnected. R2 is used to produce a small amount of hysteresis in the circuit such that the charging stops at about 4.2 volts and will not start again until the battery voltage has fallen to about 3.8 volts. The op-amp output is also taken via r6 to switch q1 and hence illuminates the Led, d2, to indicate when the battery is charging.

When sw1 is operated power is applied to 1*c*1 and its associated circuitry. ICI is a Hybrid-Intergrated circuit containing both an integrated RF transmitter, requiring minimal external components, and an 8-bit microprocessor having six 10 pins and internal 4 MHz clock generator, when powered up the software in the microprocessor reads a 5-bit code from the di1 switch sw2 and generates a pseudo-randomly spaced data stream on gp5 output pin. The data is coded so as to produce one data word every 2 to 66 ms. Each word consists of six bits; one start bit and 5 data bits directly representing the settings of SW2. The start bit is a 300 us pulse and the data bits are 5 width-modulated-pulses with a cycle length of 900 us and a duty time of either 300 or 600 us. The random time generator is seeded from the 5-bit code and thus each transmitter will produce a different random sequence. This ensures that the outputs of more than one transmitter used simultaneously produce-only very limited interference with each other. The data signal is used to switch the transmitter oscillator on and off thus producing a suppressed carrier amplitude modulation (AM) signal at the output of the transmitter. The transmitter uses a PCB track as a loop antenna tuned by C4. frequency reference is provided by a crystal, X1, this oscillates at 13.56 MHz and is internally multiplied by 32 to produce a carrier frequency of 433.92 MHz. When recharging power is applied to the circuit Q2 is switched on via R1 and this in turn pulls the enable pin of the transmitter to ground disabling the RF output when charging of the battery is taking place. C5, C6 and R11 form a loop filter for the RF oscillator and have been selected to give a fairly fast oscillator start-up time. D3 is powered whenever SW1 is operated and give a visual indication of transmitter operation. C1, C2 and C3 are supply bypass capacitors.

In addition to the loop antenna on the pcb, an insulated wire is incorporated in the arm strap of the transmitter box. This absorbs some of the radiated signal from the loop and re-radiates the RF signal to enable a better transmission when the circuit is mostly obscured by the body and clothing.

Description of SHAD RC2002 Receiver

FIG. 8

The live and neutral mains inputs are on cn1 these are taken to transformer tf1 to power the low voltage circuitry and via L1 and t2 to supply the sewing machine lamp and the phase angle control circuit for the motor. L1 and L2 provide mains filtering to prevent transient spikes from being transmitted back down the mains path in addition the pcb tracks and internal machine wiring are protected by a one-amp HRC fuse.

Diodes d2 and d4 full-wave rectify the output of tf1 and this is smoothed by c2 to give about 8 volts dc. The 8 volts is then regulated to 5 volts by the lowdropout regulator u2, this is then used to power the phase control circuit microprocessor and radio receiver module and is also taken to cn3 to provide power to recharge the transmitter. Diodes d1 and d3 produce a full wave rectified signal, which is then taken to the phase control circuit. R5 provides a signal discharge path and the rectified signal is then taken via r4 to the input of a schmitt trigger inverter. The zener diode d5 is used to clip the signal and provide over voltage protection to u4*c*. The output of u4*c* is a set of positive pulses coinciding with mains zero crossing, this is then inverted by u4*b* to provide a positive going pulse during each mains half cycle, this then charges C4 via the network of R6, R7 and R8, when the voltage on U4A input reaches its positive threshold level then its output switches to a low level, at the end of the pulse D6 is used to quickly discharge C4 ready for the next half cycle, by adjusting R8 and R7 the time taken to trigger U4A can be varied and thus the percentage of mains cycle presented to the motor.

The receiver module M1 is a simple AM detecting receiver with an intergrated data separator to provide a digital output which goes positive when carrier is received. The digital output is taken to a microprocessor, U3 and this is programmed to decode the incoming data waveform and compare it with the settings on Dil switch SW1. Once two correct consecutive data words are detected then the RA3 output is switched high, the incoming data is then monitored and provided there is a correctly received data word at least every 250 ms then the output remains high. The signal from RA3 is then taken via RI0 to D8, to give a visual indication of data received, and then to LED positive side of opto-isolator U1. This produces an "and" function with the signal from U4A and causes the mains side triac to be triggered while good data is being received.

C1, R1 and R2 form a suppression circuit for the driver triac in U1, the main triac; TR1 is used to supply the power to the motor. TR1 is a 'SNUBBER-LESS' triac and requires no suppression of its own. The phase controlled live output from TR1 is taken to CN2 to provide power to the motor in the machine. R9 and D7 provide an indicator to show when mains power is applied to the unit. C10 and C5 provide bypass filtering for the 5-volt supply.

The invention claimed is:

1. A sewing machine having a microprocessor controlled switch and a manual motor speed controller provided independently on the machine body, the sewing machine being provided with a battery powered radio transmitter to operate the switch remotely and an associated receiver on the body of the machine, the transmitter using digitally coded signals to avoid interference with other remotely controlled sewing machines in the vicinity, the transmitter having a single crystal or saw device oscillator and a microprocessor which generates a psuedo-randomly spaced data stream, the transmitter operating with amplitude modulation. the switch being controlled so as to stop the machine if the stream of data is interrupted, the transmitter having a strap for attachment to an operator, the strap incorporating a wire to help with the propagation of the transmitted signal, the transmitter being adapted to be physically connected to a box housing the receiver in order to recharge the transmitter battery, the transmitter being disabled from operating the switch while its battery is being recharged.

2. A sewing machine as claimed in claim 1 in combination with a second transmitter so that one transmitter can be used while the other is being recharged.

3. A sewing machine according to claim 1 or claim 2 in which a box housing the transmitter has LEDs to indicate operating and recharging functions and the box of the receiver has LEDs to indicate power and operation and also has an IEC mains connector.

* * * * *